US007311053B2

(12) United States Patent
Eiken

(10) Patent No.: US 7,311,053 B2
(45) Date of Patent: Dec. 25, 2007

(54) SUPPORT VESSEL

(75) Inventor: Trygve Eiken, Fitjar (NO)

(73) Assignee: Vik - Sandvik AS, Fitjar (NO)

( * ) Notice: Subject to any disclaimer, the term of this patent is extended or adjusted under 35 U.S.C. 154(b) by 0 days.

(21) Appl. No.: 10/565,245

(22) PCT Filed: Apr. 6, 2004

(86) PCT No.: PCT/NO2004/000104

§ 371 (c)(1),
(2), (4) Date: Feb. 2, 2006

(87) PCT Pub. No.: WO2004/089739

PCT Pub. Date: Oct. 21, 2004

(65) Prior Publication Data

US 2006/0213419 A1 Sep. 28, 2006

(30) Foreign Application Priority Data

Apr. 10, 2003 (GB) ..... 0308322.7

(51) Int. Cl.
*B63B 25/00* (2006.01)

(52) U.S. Cl. ..... 114/72

(58) Field of Classification Search ..... 114/61.3, 114/72, 74 R, 264; 441/3, 4
See application file for complete search history.

(56) References Cited

U.S. PATENT DOCUMENTS 3,318,276 A * 5/1967 Nemec ..... 114/72
3,386,405 A * 6/1968 Knight, Jr. et al. ..... 114/72
3,977,352 A 8/1976 Pran et al.
4,008,675 A * 2/1977 Johansson ..... 114/72
4,043,285 A * 8/1977 Nordstrom ..... 114/72
4,111,145 A * 9/1978 Ohsaka ..... 114/72
4,138,961 A * 2/1979 Roper ..... 114/72
5,893,333 A * 4/1999 Smedal ..... 441/4
6,769,376 B2 * 8/2004 Perera et al. ..... 441/4

FOREIGN PATENT DOCUMENTS

| | | |
|---|---|---|
| DE | 3921266 | 1/1991 |
| GB | 1207690 | 10/1970 |
| JP | 61191494 | 8/1986 |
| JP | 61241293 | 10/1986 |
| WO | WO 01/48351 | 7/2001 |

* cited by examiner

*Primary Examiner*—Lars A. Olson
(74) *Attorney, Agent, or Firm*—Christian D. Abel

(57) ABSTRACT

The invention regards a multipurpose support vessel (1), comprising a hull (2) with a bow (3) and a stern (4) and with a propulsion arrangement (5), a bridge (6) and accommodation quarters (7) and storage areas (8) for loads and cargo. On the vessel (1) the bridge (6) and accommodation quarters (7), which forms a superstructure, are located in the aft part of the vessel (1). Almost all storage areas (8) for loads and cargo are positioned between the superstructure (6,7) and the bow section (3) of the vessel. The invention also regards a method for loading/unloading the vessel (1) at an offshore installation.

6 Claims, 5 Drawing Sheets

Figure 1:
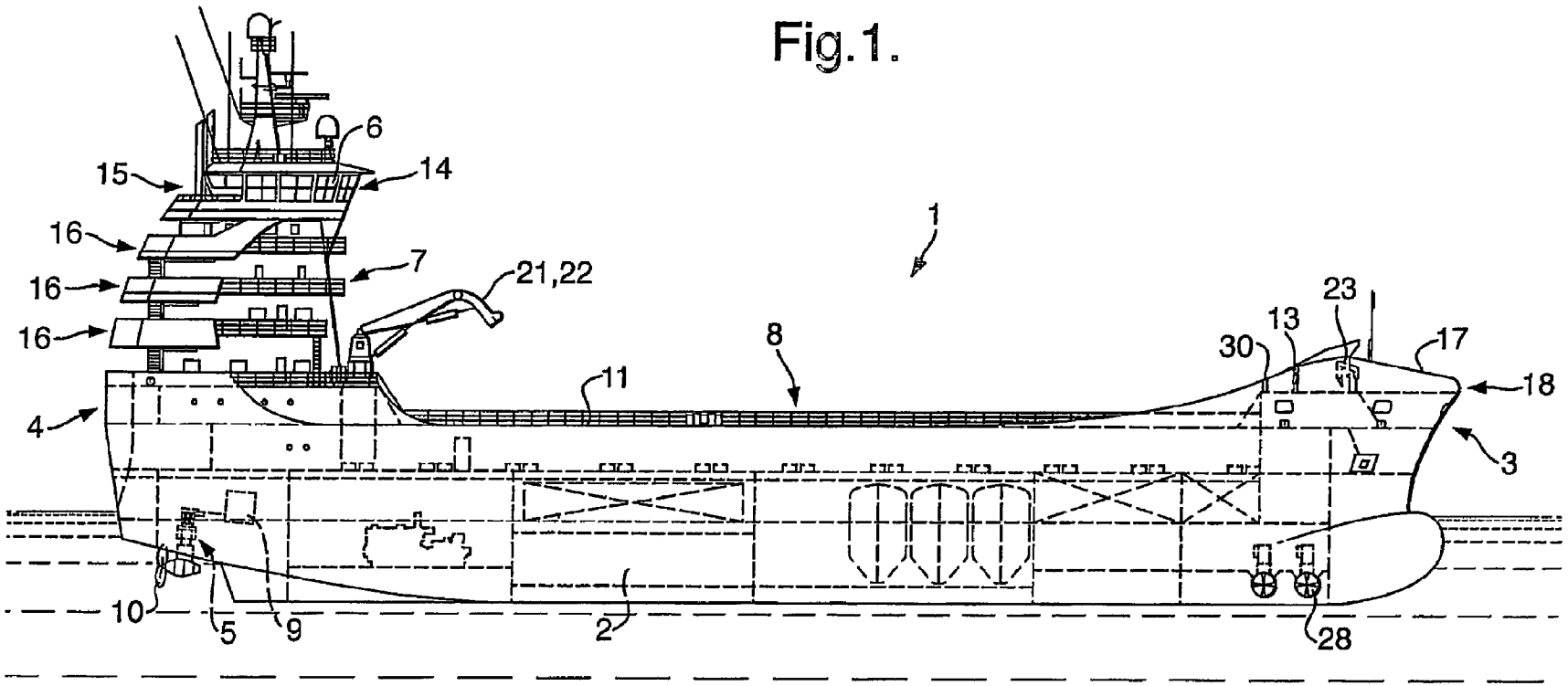

14B 20
15

16

16

17
16

SUPPORT VESSEL

The present invention relates to a multipurpose support vessel and a method for loading/unloading such a vessel at an offshore installation.

Support vessels are used to large extent for transporting goods and cargo to, between and from offshore installations e.g. platforms, semi submersibles and FPSOs. These support vessels are formed with a hull structure with a bow and a stern. The bridge and accommodation quarters are positioned in the forward section of the vessel. This has been the traditional design of support vessels for as long as support vessels have been used in connection with offshore installations. When unloading/loading at the offshore installation the known support vessels are backed towards the platform, so that the stern section of the support vessel is closest to the platform. This traditional design construction gives several disadvantages, the bridge and accommodation quarters are located in a part of the vessel which experience large movements due to weather influence which makes the working environment quite uncomfortable. A known traditional support vessel would have to be backed towards the offshore installation for unloading to the installation, and therefore there is a need for two bridge consoles facing opposite directions. The connection points for hoses in the stern of the support vessel are also exposed to weather conditions and swinging cargo.

An aim with the present invention is to provide a multipurpose support vessel, with at least the same flexibility and handling capacity as know support vessels but where the comfort and working environment for the crew is improved. There is also an aim to achieve a multipurpose support vessel with only one manoeuvring console in the wheelhouse. Another aim is to achieve a multipurpose support vessel with slimmer hull lines and reduced resistance, hence better fuel economy. It is also an aim to achieve a support vessel with improved handling characteristic with regard to manoeuvring and less influenced by the weather conditions. It is also an aim to achieve a support vessel which is easier and more cost efficient to construct and operate. Another aim is to achieve a multipurpose support vessel where the cargo area beneath the deck is optimized in comparison with known solutions.

The above mentioned aims are achieved with a multipurpose support vessel according to the following claims.

A multipurpose support vessel according to the invention is usually used in connection with supporting offshore installations for transporting cargo and equipment to, between and from these offshore installations. An offshore supply vessel is primarily engaged in the transport of stores, materials and equipment to offshore installations. The support vessel according to the invention will mainly be used as an offshore supply vessel. A support vessel according to the invention will also normally be designed with respect to IMO damage stability requirements such that it can operate within the 500 m safety zone around an offshore installation. The support vessel will also have propellers, thrusters and control system which makes it possible for the vessel to stay in position close to an offshore installation. The support vessel according to the invention also has clear working deck with as few obstructions as possible to enable safe cargo handling in open sea.

The vessel according to the invention has a hull with propulsion arrangement, a bridge, accommodation quarters and large storage areas for different kind of loads and cargo. The support vessel according to the present invention has the bridge and the accommodation quarters arranged in the aft part of the vessel. The accommodation quarters are located underneath the bridge. The accommodation quarters and bridge are normally referred to as superstructure. The main cargo storage areas are located forward of the superstructure, between the superstructure and the bow of the vessel.

This arrangement of the superstructure gives several favourable advantages both during operation of the vessel and also during construction. By having the bridge and accommodation quarters at the stem of the support vessel one achieves an improved working environment for the crew on the support vessel. Generally the stern of a vessel experiences less movement during normal operation. Compared with known support vessel the crew on a support vessel according to the present invention will experience reduced motion during sailing mode and also a reduced need to use extra force to keep the working position, hold oneself steady in relation to the vessel when it moves. This leads to a more comfortable working environment with less seasickness, better rest periods and better job satisfaction. By having to use less force and also time to keep the working position the work will be done quicker and this both gives reduced operation costs and is especially favourable for operation offshore where the time it takes for doing an operation, sometimes is crucial.

By positioning the bridge at the stern it is only necessary to have one manoeuvring consol on the bridge. This is favourable both with regard to safety and also working environment. A known traditional support vessel has two manoeuvring consoles facing opposite directions. In the present invention the same and only bridge console may be used both during normal sailing and also when loading/unloading at an installation offshore as for instance a platform. There is no need for the crew to turn around and then manoeuvre the vessel from another console facing the opposite direction with the difficulties this entails in shifting the crewsyou mindset of where the boundaries of the vessel are. The present invention therefore gives an improved working environment for the crew. From a safety perspective the present invention is an improvement compared with known support vessel since the possibilities of both human and mechanical failure are reduced. It is also favourable from a construction point of view in that there is only one consol at the bridge deck, which makes the design easier and construction less expensive, there is also less equipment that may fail.

Another benefit of having the bridge and the accommodation quarters at the stern of the vessel above the main propellers is that one achieves a more favourable behaviour of the vessel as a response to the influence of the weather conditions when keeping the vessel in a position, e.g. the DP-plot (dynamic positioning plot) gives a much better result when the bridge and accommodation quarter is located at the stern of the vessel compared with location at the forward section of the vessel. Hence the vessel according to the present invention has a larger operational window since it can keep a position at higher wind levels than known support vessels with the same thruster configuration. Due to that the accommodation and bridge are located at the stern, the same thruster configuration will give a better DP-plot compared with conventional support vessels. This means it can load/unload at higher wind speeds compared with known supply vessels, with the same thruster configuration. Therefore there is also a higher degree of security in relation to manoeuvring of the support vessel according to the present invention compared with known support vessels.

Having the main storage areas for loads and cargo between the bridge and the bow section of the vessel gives full view of those areas from the one consol in the bridge during all operations, which is favourable.

Another characterising feature of the present invention is an access opening in the stern of the vessel that goes through and/or below the accommodation quarters of the vessel, to the storage areas of the vessel. This gives the possibility to load/unload the vessel by bringing the loads or cargo in and out of the vessel at the stern of the vessel, by for instance positioning a ramp between the wharf at the docking site an the opening and transporting loads or cargo by truck or other equipment to the storage areas in the vessel by the ramp and the opening.

Another advantage with the characterising features of the present invention is a protected work area for hose and pipe connections. A lot of loads and cargo to, between and from an offshore installation is in a fluid-form and the transferral from or to the support vessel is done by hose or pipeline connection. With the present invention the support vessel approaches the platform with the bow section, where the pipe and hose connections are located. These connections are located in a protected area behind the breakwater hood. This gives a good, sheltered working conditions for the crew on the support vessel.

With the bridge and accommodation quarters at the stern section of the vessel one may also locate the drive units for the propulsion arrangements in the stern section. This gives several benefits compared with known support vessel. By having the drive units at the stern there is a need for only short shafts from the drive units to the propellers. Instead of a solution which is most commonly used in support vessel, where shafts run from a drive unit located forward in the vessel, underneath the bridge, through the whole vessel to the propellers aft. By having just a short link between the drive unit and the propeller one also achieves a much better usage of the areas beneath the main cargo deck. The solution is also cheaper in construction and maintenance since there among other things are no long shafts and bearings for the shafts. It also gives the possibility of using azimuth thrusters at the stern instead of tunnel thrusters. This reduces noise level in the accommodation quarters and thereby better working conditions.

Another benefit with the positioning of the drive unit for the propulsion arrangements in the aft is the possibility to design a support vessel with more hydrodynamic lines for the hull, a slimmer bow section. This gives a vessel with reduced resistance and higher efficiency compared with known support vessels. There is also a possibility to modulate the construction of the support vessel, since all the main features are placed above each other in the stern of the vessel.

In this sense the positioning of the drive units for the propulsion arrangements in the stern gives a more economic solution both during construction and operation of the vessel.

The invention also regards a method for loading/unloading a support vessel at an offshore installation. The vessel is brought up to the installations docking area with the bow section, with the use of loading/unloading equipment on the vessel and on the installation the loads and cargo is loaded/unloaded, thereafter the vessel is backed away from the platform. During the loading/unloading the crew on the vessel operation may position themselves in the protected area of the working area in the bow section of the vessel.

Figures 2, 3, 4, 5, 6:
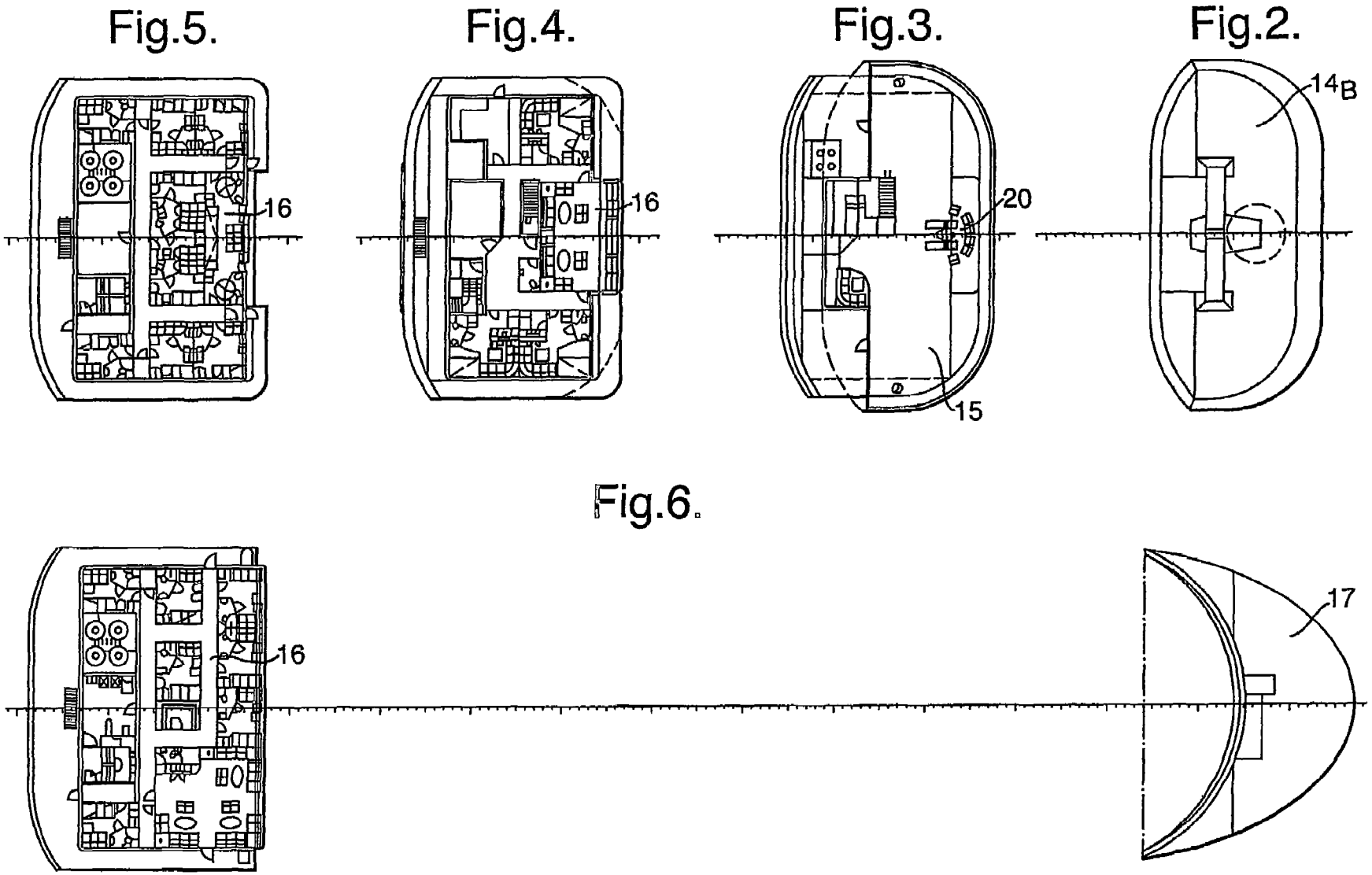
Figure 7:
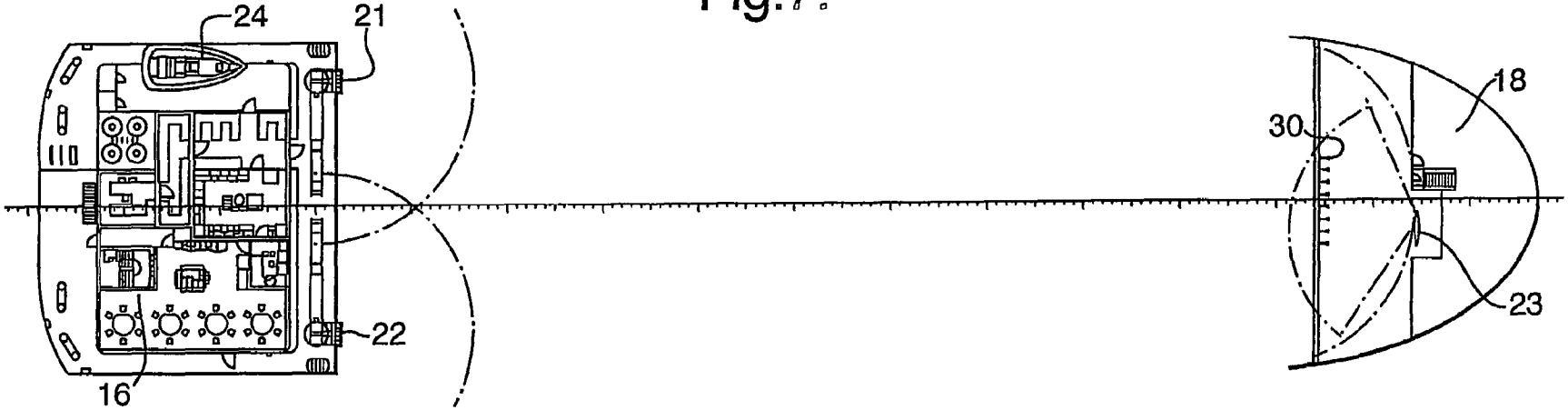
Figure 8:
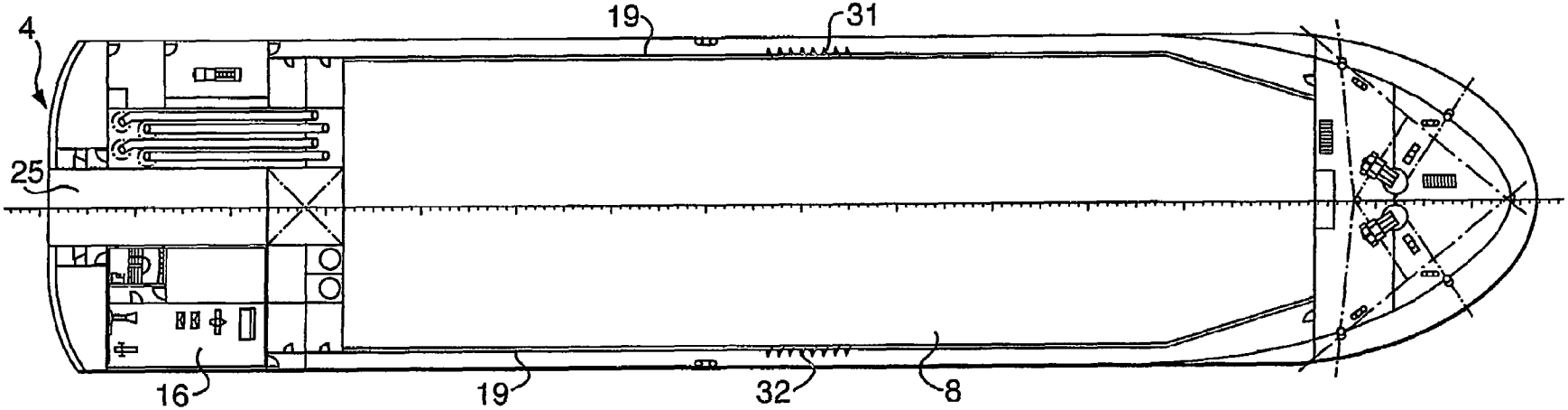
Figure 9:
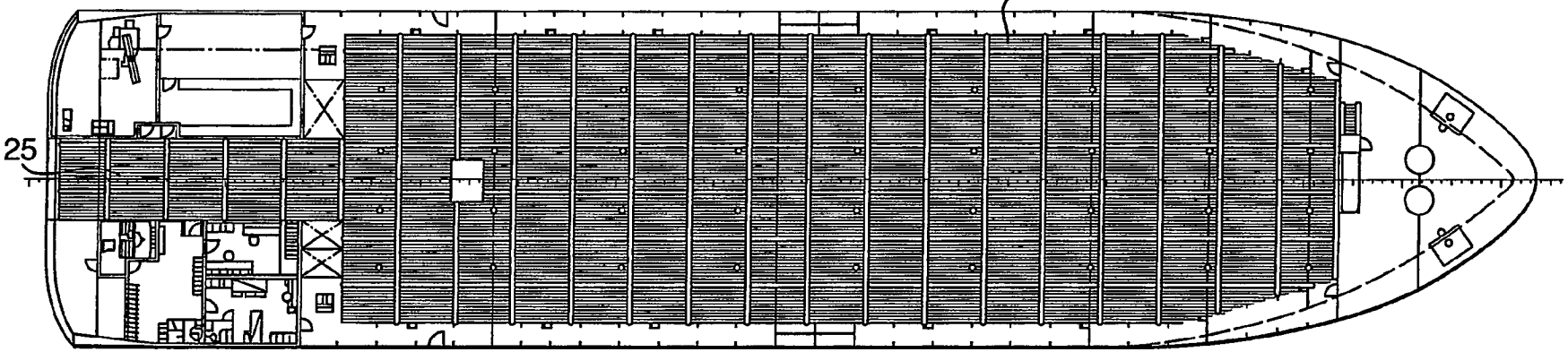
Figure 10:
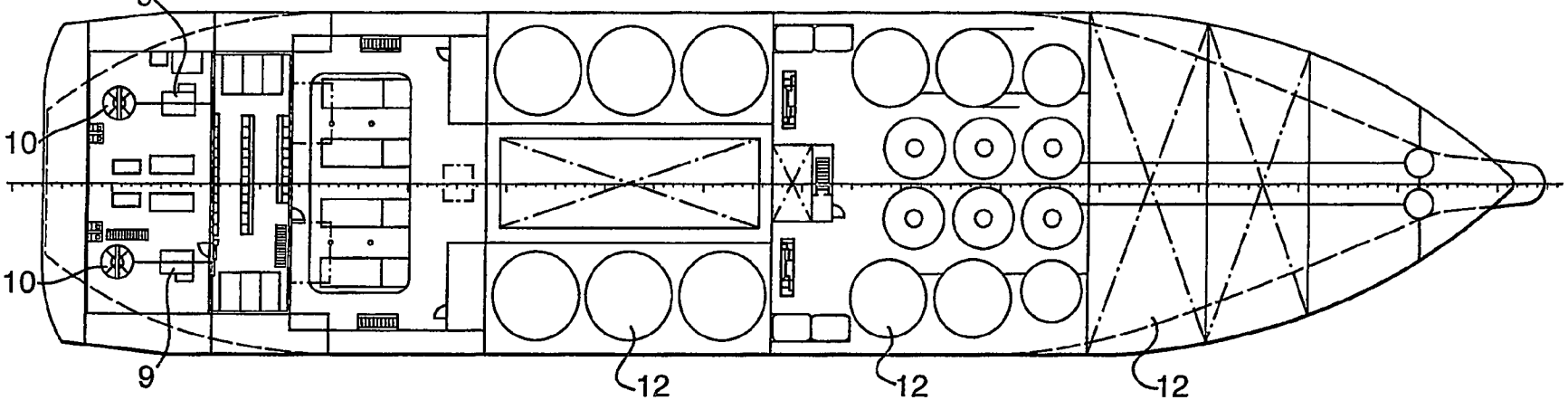
Figure 11:
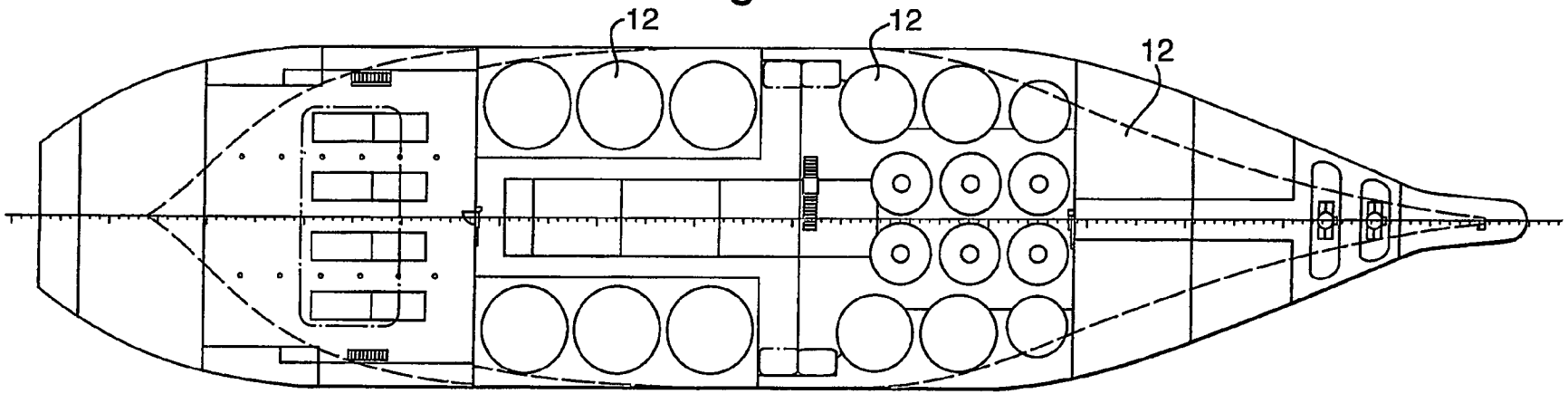
Figure 12:
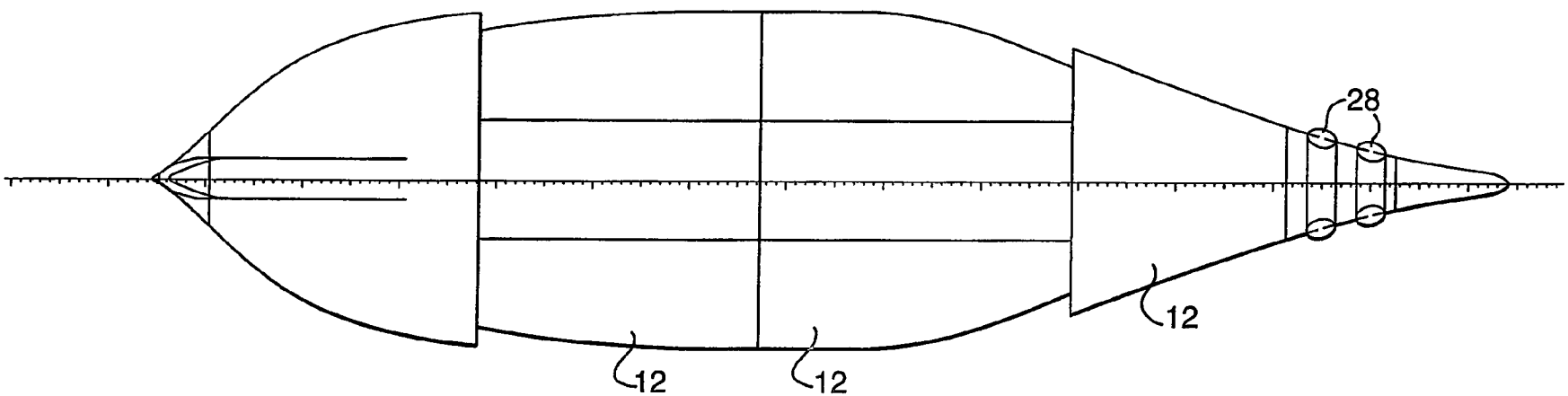

The invention will now be explained in more detail with an embodiment of the invention and reference to the accompanying drawing where:

FIG. 1 is a side sketch of a support vessel according to the invention,

FIGS. 2-12 are cross sections of the vessel in a mainly horizontal plan mainly equal to each deck in the vessel, where FIG. 2 is the top of the wheelhouse FIG. 3 is the bridge deck FIG. 4 is the $4^{th}$ accommodation deck FIG. 5 is the $3^{rd}$ accommodation deck FIG. 6 is the $2^{nd}$ accommodation deck with the breakwater hood in the bow section of the vessel FIG. 7 is the $1^{st}$ accommodation deck with the forecastle deck in the bow section of the vessel, FIG. 8 is the ground accommodation deck, FIG. 9 is the $1^{st}$ deck, FIG. 10 is the $2^{nd}$ deck, FIG. 11 is showing a cross section at the top of the tanks, and FIG. 12 is showing a cross section below the tank top.

There is shown one embodiment of the invention in the accompanying drawings. FIG. 1 shows a side sketch of the vessel 1, with a hull 2 which has a bow section 3 and a stern section 4 or called the aft part. The vessel has a propulsion arrangement 5 with main thrusters in the aft comprising a drive unit 9 and propellers 10. The vessel according to the invention will also have forward thrusters 28 for manoeuvring. The bridge 6 and accommodation quarters 7 are located in the aft part 4 of the vessel 1. In this embodiment there are four levels of accommodation decks 16 above the main deck 11. The aft sections of the accommodation decks 16 have an exterior which are rounded in parts both in a vertical and horizontal direction to form a smooth transition between the different levels and the comers of the levels. The bridge 6 is located in the wheelhouse 14 on the bridge deck 15, which is located on the top of the accommodation quarters 7. The wheelhouse has windows facing all directions to get a good view from the bridge.

The main storage area 8 of the vessel 1 is located forward of the bridge 6 between the bridge 6 and the bow section 3 of the vessel. In the aft of this storage area 8 there are arranged a pair of lifting cranes, 21 and 22 respectively. In addition is there arranged a lifting crane 23 in the bow section 3 of the vessel 1. The main storage area comprises the main deck level 11 and storage facilities beneath the main deck level 11 in the form of different kind of tanks 12 within the hull 2.

The different kind of tanks 12 may contain fluid or bulk material. For loading and unloading this fluid or bulk material, the vessel is equipped with pipe and/or hose connection points 30 at the bow section 3 of the vessel and also mid ship on both sides of the vessel, 31 and 32 respectively (see FIG. 8). The pipe/hose connections 30 are located at the bow section 3 and by this location also protected by the breakwater hood 17 at the bow section 3. The forward crane 23 handles pipes and hoses that should be connected to the pipe/hose connection points 30. Parts of this section of the vessel is protected by the breakwater hood 17 at the bow section 3 of the vessel 1, the crew 13 may therefore work in a protected area on the forecastle deck 18, where they are protected from the weather conditions and also swinging and unsecured cargo.

The FIGS. 2-12 are cross sections taken along mainly horizontal planes in the vessel according to the invention at eleven levels in the vessel. FIG. 2 is showing the top of the wheelhouse 14. On top of the wheelhouse 14 there will be standard equipment for navigation, radio etc. FIG. 3 is showing the bridge deck 15 and the layout of this deck.

There is located one bridge console 20 at the bridge deck 15. The console 20 is facing forward, with the full view of the main cargo area 8 of the vessel 1 during normal sailing and also loading/unloading operations.

The $4^{th}$ accommodation deck 16 is shown in FIG. 4, and the $3^{rd}$ accommodation deck 16 in FIG. 5. These deck levels comprise cabins, lounge, ships office etc. The layout of these different deck levels are not a part of the invention, and may vary both in number and layout.

In FIG. 6 is shown the $2^{nd}$ accommodation deck 16 and also the breakwater hood 17 in the bow section 3 of the vessel 1. These are on the same level.

The $1^{st}$ accommodation deck 16 is shown in FIG. 7 together with the forecastle deck 18 in the bow section 3 of the vessel 1. There is also indicated a MOB-boat 24 (man over board—boat) at the side of the accommodation deck 16. Further there is indicated two cranes, 21 and 22 just forward of the accommodation. These cranes 21 and 22 handle cargo during loading and unloading of the vessel 1. Further is there at the forecastle deck 18 indicated several pipe and/or hose connection points 30 and a forward crane 23. The forward crane 23 has as a main task to handle pipes and hoses for connection to the connecting points 30.

FIG. 8 is showing the lowest accommodation deck. The rail 19 alongside the main deck is indicated in this figure. Pipe and hose connection points along both sides of the vessel are also indicated, 31 and 32 respectively. There are through the accommodation deck 16 shown an access opening between the main storage area 8 and the stern 4 of the vessel.

The $1^{st}$ main deck 11 is shown in FIG. 9, where the access opening 25 is clearly indicated with a same sketching as the main deck 11. FIG. 10 is showing the $2^{nd}$ deck beneath the main deck 11. In this sketch there is indicated several types of tanks 12. The drive units 9 for the main thrusters are indicated together with the propellers 10. FIG. 11 is showing a cross section at the top of the tanks 12, and FIG. 12 is showing a cross section below the tank top, where one can se an indication of the forward side thrusters 28.

The invention has now been explained with one embodiment and reference to the accompanying drawings. Several modifications and alterations may be done by a skilled person in the art which are within the scope of the invention as defined in the following claims. The number of accommodation decks may be changed, there may be a smaller cargo area between the bridge and the stern of the vessel, there may be other propulsion arrangements, the tank configuration may be varied, the access opening may be formed in a different manner, part of the accommodation quarters may be located in another place etc.

The invention claimed is:

1. Multipurpose support vessel (1), comprising a hull (2) with a bow (3) and a stern (4) and with a propulsion arrangement (5), a bridge (6) and accommodation quarters (7) and storage areas (8) for loads and cargo, where the bridge (6) and accommodation quarters (7) form a superstructure and are located in the aft part of the vessel (1) and almost all storage areas (8) for loads and cargo are positioned between the superstructure (6,7) and the bow section (3) of the vessel, characterised in that there is access opening (25) from the outside of the stern (4) of the vessel through and or below the accommodation quarters (7), to the storage areas (8) of the vessel, and that there is a working platform for hose connections in the bow (3) of the vessel.

2. Vessel according to claim 1, characterised in that parts of the working platform in the bow section (3) of the vessel is protected by a breakwater hood (17) in the bow section (3).

3. Vessel according to claim 1, characterised in that a wheelhouse (14) comprises only one bridge console (20).

4. Vessel according to claim 1, characterised in that there are pipe and/or hose connection points (30) in the bow section of the vessel.

5. Vessel according to claim 1, characterised in that a drive unit (9) for the propulsion arrangement (5) is in the aft part of the vessel.

6. Vessel according to claim 1, characterised in that the propulsion arrangement (5) comprises azimuth propellers in the aft of the vessel.

* * * * *